US008053967B2

(12) United States Patent
Xiao et al.

(10) Patent No.: US 8,053,967 B2
(45) Date of Patent: Nov. 8, 2011

(54) ELECTRON EMISSION DEVICE AND DISPLAY DEVICE USING THE SAME

(75) Inventors: Lin Xiao, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 240 days.

(21) Appl. No.: 12/319,047

(22) Filed: Dec. 31, 2008

(65) Prior Publication Data

US 2009/0256462 A1 Oct. 15, 2009

(30) Foreign Application Priority Data

Apr. 9, 2008 (CN) ..... 2008 1 0066515

(51) Int. Cl.
*H01J 9/02* (2006.01)

(52) U.S. Cl. ..... 313/310; 313/311; 313/309; 313/495

(58) Field of Classification Search ..... 313/414, 313/441–460, 495–497, 293–304, 306, 309–310, 313/346, 351, 355; 438/20
See application file for complete search history.

(56) References Cited

U.S. PATENT DOCUMENTS

| | | | | |
|---|---|---|---|---|
| 6,630,772 | B1 * | 10/2003 | Bower et al. | 313/311 |
| 6,943,493 | B2 | 9/2005 | Uemura et al. | |
| 7,319,288 | B2 | 1/2008 | Liu et al. | |
| 7,569,158 | B2 | 8/2009 | Waller et al. | |
| 2001/0019238 | A1 * | 9/2001 | Dai et al. | 313/309 |
| 2005/0215165 | A1 | 9/2005 | Uemura et al. | |
| 2005/0275331 | A1 | 12/2005 | Takai et al. | |
| 2006/0066202 | A1 * | 3/2006 | Manohara et al. | 313/311 |
| 2007/0075619 | A1 * | 4/2007 | Jiang et al. | 313/336 |
| 2008/0020499 | A1 * | 1/2008 | Kim et al. | 438/20 |
| 2008/0036358 | A1 * | 2/2008 | Takai | 313/495 |
| 2009/0115305 | A1 * | 5/2009 | Segal et al. | 313/300 |

FOREIGN PATENT DOCUMENTS

| | | | |
|---|---|---|---|
| CN | 1428813 | A | 7/2003 |
| CN | 1781968 | A | 6/2006 |

* cited by examiner

*Primary Examiner* — Nimeshkumar Patel
*Assistant Examiner* — Donald Raleigh
(74) *Attorney, Agent, or Firm* — Altis Law Group, Inc.

(57) ABSTRACT

An electron emission device includes a cathode electrode and a gate electrode, the gate electrode is separated and insulated from the cathode electrode, the gate electrode is a carbon nanotube layer, and the carbon nanotube layer includes a plurality of carbon nanotube wire-like structures. A display device that includes the electron emission device is also disclosed.

20 Claims, 7 Drawing Sheets

ELECTRON EMISSION DEVICE AND DISPLAY DEVICE USING THE SAME

RELATED APPLICATIONS

This application is related to applications entitled, "ELECTRON EMISSION DEVICE AND DISPLAY DEVICE USING THE SAME", filed; "ELECTRON EMISSION DEVICE AND DISPLAY DEVICE USING THE SAME", filed. The disclosures of the respective above-identified applications are incorporated herein by reference.

BACKGROUND

1. Technical Field

The invention relates to an electron emission device and a display device using the electron emission device.

2. Discussion of Related Art

Electron emission displays are new, rapidly developing in flat panel display technologies. Compared to conventional technologies, e.g., cathode-ray tube (CRT) and liquid crystal display (LCD) technologies, Field Electron emission Displays (FEDs) are superior in having a wider viewing angle, low energy consumption, a smaller size, and a higher quality display.

Generally, FEDs can be roughly classified into diode type structures and triode type structures. Diode type FEDs has only two electrodes, a cathode and an anode. Diode type FEDs can be used for character display, but are unsatisfactory for applications requiring high-resolution display images, because of they are relatively non-uniform and there is difficulty in controlling their electron emission.

Triode type FEDs were developed from the diode type by adding a gate electrode for controlling electron emission. Triode type FEDs can emit electrons at relatively lower voltages. A conventional triode type electron emission device includes a cathode electrode, a gate electrode spaced from the cathode electrode. Generally, an insulating layer is deposited on the cathode electrode for supporting the gate electrode, e.g., the gate electrode is formed on a top surface of the insulating layer. The cathode electrode includes an emissive material, such as carbon nanotube. The gate electrode includes a plurality of holes toward the emissive material, these holes are called gate holes. In use, different voltages are applied to the cathode electrode and the gate electrode. Electrons are emitted from the emissive material, and then travel through the gate holes in the gate electrode.

The conventional gate electrode is a metal grid, the metal grid has a plurality of gate holes. The small size gate holes make for a more efficient high-resolution electron emission device. Generally, the metal grid can be fabricated using screen-printing or chemical etching methods. Areas of the gate holes in the metal grid are often more than 100 $\mu m^2$, so the electron emission device cannot satisfy some needs requiring great accuracy. The uniformity of the electric field cannot be improved by decreasing the size of the gate holes, and thus, the performance of electron emission is restricted. Further, the method for making the metal grid requires an etching solution, and the etching solution may be harmful to the environment. Additionally, the grid made by metal material is relatively heavy, and restricts applications of the electron emission device.

What is needed, therefore, is an electron emission device and a display device using the same having high efficiency, high-resolution and light weight.

BRIEF DESCRIPTION OF THE DRAWINGS

Many aspects of the electron emission device and the display device can be better understood with references to the following drawings. The components in the drawings are not necessarily drawn to scale, the emphasis instead being placed upon clearly illustrating the principles of the present electron emission device and the display device.

Corresponding reference characters indicate corresponding parts throughout the several views. The exemplifications set out herein illustrate at least one embodiment of the present electron emission device and displaying device.

DETAILED DESCRIPTION OF EXEMPLARY EMBODIMENTS

References will now be made to the drawings to describe the exemplary embodiments of the electron emission device and display device using the same, in detail.

Figure 1:
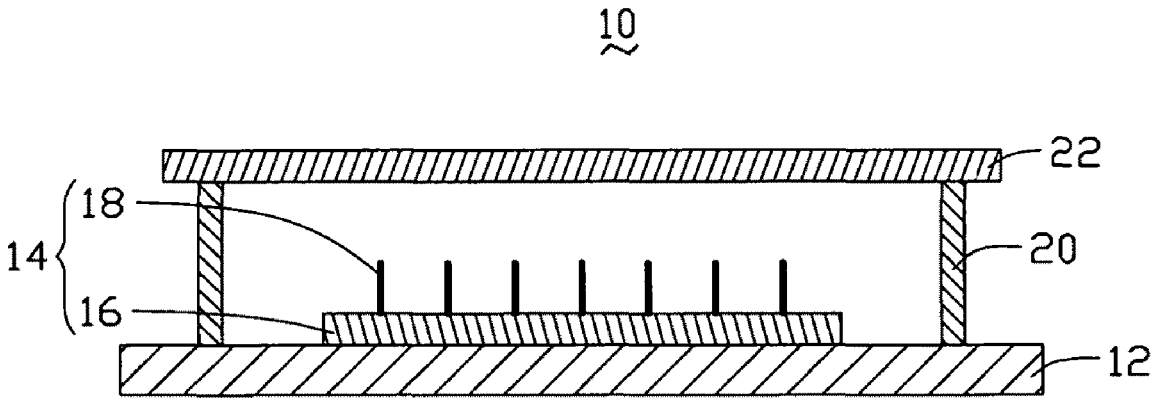
FIG. 1 is a schematic, cross-sectional view, showing an electron emission device, in accordance with a present embodiment.

Referring to FIG. 1, an electron emission device 10 includes a substrate 12, a cathode electrode 14, and an insulating supporter 20. The cathode electrode 14 and the insulating supporter 20 are disposed on the substrate 12. Further included is a gate electrode 22 formed on a top surface of the insulating supporter 20. The gate electrode 22 is electrically insulated from the cathode electrode 14 by the insulating supporter 20.

The substrate 12 comprises of an insulating material, such as glass, silicon, ceramic, etc. The substrate 12 is used to support the cathode electrode 14. The shape of the substrate 12 can be determined according to practical needs. In the present embodiment, the substrate 12 is a ceramic substrate.

The cathode electrode 14 can be a field emission cathode electrode or a hot emission cathode electrode, the detailed structure of the cathode electrode 14 is not limited. The cathode electrode 14 includes at least one electron emitter. When more than one electron emitter is used, they can be configured to form an array or any other pattern. In the present embodiment, the cathode electrode 14 is a field emission cathode electrode. The cathode electrode 14 includes a conductive layer 16 and a plurality of electron emitters 18 disposed thereon. The conductive layer 16 is located on the substrate 12. The electron emitters 18 are electrically connected to the conductive layer 16. The material of the conductive layer 16 can be made of metal, alloy, indium tin oxide (ITO) or any other suitable conductive materials. The electron emitters 18 can be selected from the group of silicon needles, metal needles or carbon nanotubes. In the present embodiment, the conductive layer 16 is an ITO film, the electron emitters 18 are carbon nanotubes.

The insulating supporter 20 is used to support the gate electrode 22. The detailed shape of the insulating supporter 20 is not limited; the only requirement is that the gate electrode 22 and the cathode electrode 14 are insulated from each other. The insulating supporter 20 is made of an insulating material, such as glass, silicon, ceramic, etc. In the present embodiment, the insulating supporters 20 comprised of glass. The insulating supporter 20 can be a frame disposed around the cathode electrode 14 and perpendicular to the cathode electrode 14.

Figure 2:
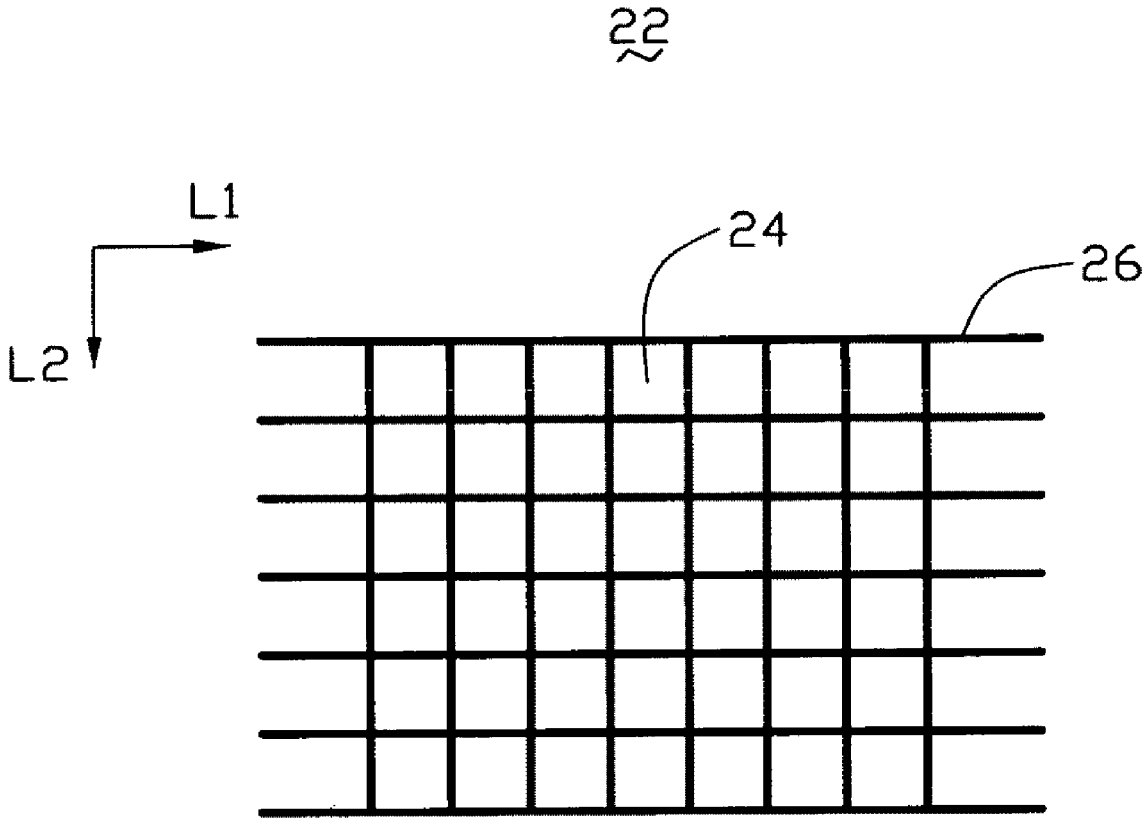
FIG. 2 is a schematic, top view, showing gate structure using a carbon nanotube layer, used in the electron emission device of FIG. 1.

Referring FIG. 2, the gate electrode 22 includes a carbon nanotube layer. The carbon nanotube layer includes a plurality of carbon nanotube wire-like structures 26, the carbon nanotube wire-like structures 26 are uniformly aligned in the carbon nanotube layer. The carbon nanotube wire-like structure 26 knitted, waved, crossed or overlapped to form a net structure. In the present embodiment, the carbon nanotube wire-like structure 26 in the net structure can be aligned in a first direction L1 and a second direction L2. The carbon nanotube wire-like structures 26 aligned along each direction are spaced a uniform distance therebetween. In another embodiment, the carbon nanotube wire-like structures 26 can also be parallel with each other, or aligned along several directions. An angle $\alpha$ between the L1 and L2 is in the range from about 0 degrees to about 90 degrees. A thickness of the carbon nanotube layer is ranged from about 2 μm to about 1 mm. A diameter of the carbon nanotube wire-like structure 26 is ranged from about 50 nm to about 500 μm.

The carbon nanotube layer includes plurality of spaces 24 used as gate holes. The spaces 24 are formed by the distance between the adjacent carbon nanotube wire-like structures 26 in the carbon nanotube layer. When the carbon nanotube wire-like structures 26 knitted or overlapped to form a net structure, the spaces 24 are the net pores in the net structure. When the carbon nanotube wire-like structures 26 are parallel with each other, the spaces 24 are the distance between two adjacent carbon nanotube wire-like structures 26. The spaces 24 distribute uniformly in the carbon nanotube layer. The spaces 24 have substantially the same size. The size of the spaces 24 depends on the distance between the adjacent carbon nanotube wire-like structures 26. In the present embodiment, the distance of the carbon nanotube wire-like structures 26 ranges from about 1 μm to 1 cm (e.g., about 3 μm), and an area of the spaces is ranged from about 1 $\mu m^2$ to 1 $cm^2$.

Figure 3:
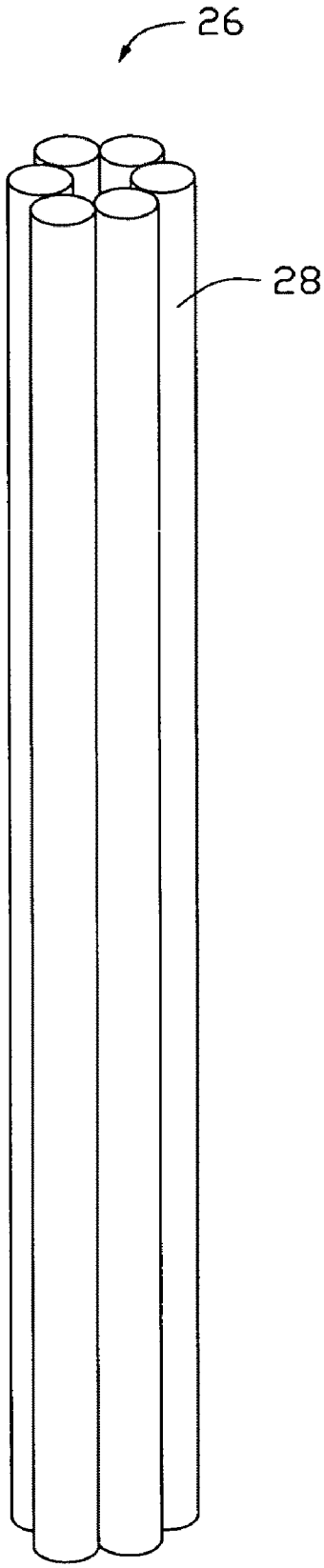
FIG. 3 is a schematic view of a carbon nanotube wire-like structure in which the carbon nanotube wires are parallel with each other.
Figure 4:
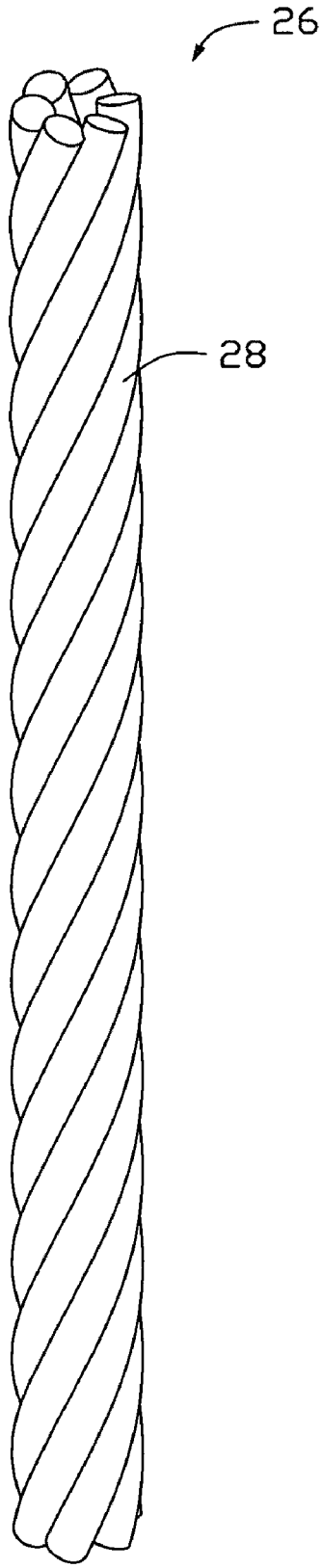
FIG. 4 is a schematic view of a carbon nanotube wire-like structure in which the carbon nanotube wires are twisted with each other.

Referring FIGS. 3 and 4, the carbon nanotube wire-like structure 26 includes at least one carbon nanotube wire 28. When the carbon nanotube wire-like structure 26 includes two or more carbon nanotube wires, the carbon nanotube wires 28 in the carbon nanotube wire-like structure 26 can be parallel with each other or twisted with each other. The carbon nanotube wire 28 includes a plurality of successive and oriented carbon nanotubes joined end to end by van der Waals attractive force.

Figure 5:
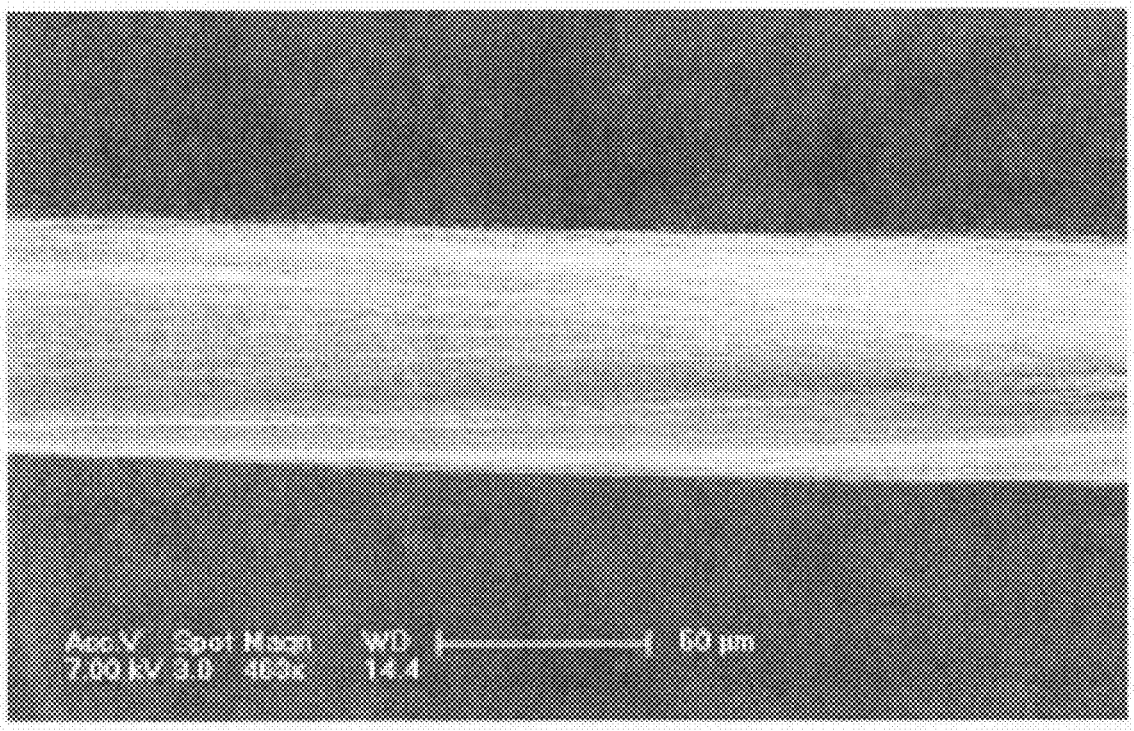
FIG. 5 is a Scanning Electron Microscope (SEM) image of an untwisted carbon nanotube wire.
Figure 6:
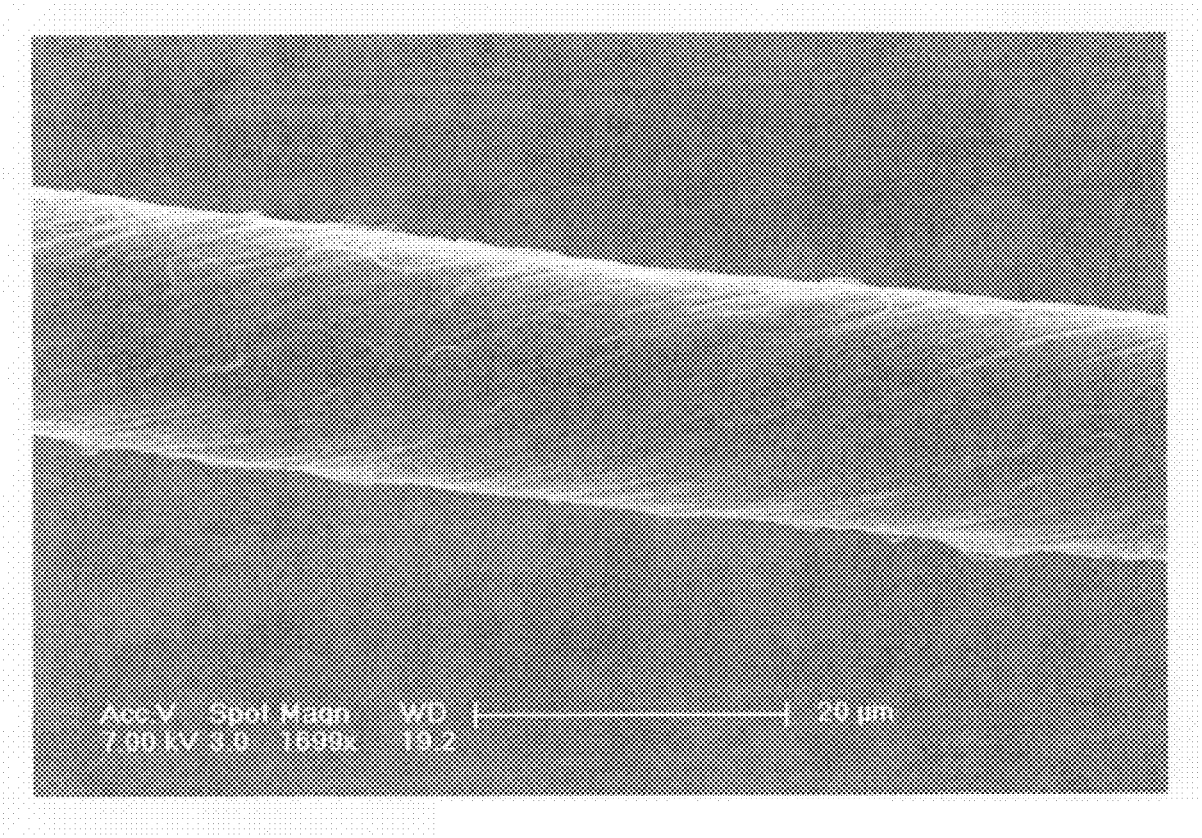
FIG. 6 is a Scanning Electron Microscope (SEM) image of a twisted carbon nanotube wire.

The individual carbon nanotube wires 28 used can be twisted or untwisted. Referring to FIG. 5, the untwisted carbon nanotube wire 28 includes a plurality of carbon nanotubes oriented along a same direction (e.g., a direction along the length (axis) of the wire). Referring to FIG. 6, the twisted carbon nanotube wire 28 includes a plurality of carbon nanotubes oriented around an axial direction of the carbon nanotube wire 28. More specifically, the carbon nanotube wire 28 includes a plurality of successive carbon nanotube segment joined end to end by van der Waals attractive force therebetween. The carbon nanotube segments can vary in width, thickness, uniformity and shape. However, the segments tend to be uniform. Each carbon nanotube segment includes a plurality of carbon nanotubes parallel to each other, and combined by van der Waals attractive force therebetween. Length of the carbon nanotube wire 28 can be set as desired. A diameter of the carbon nanotube wire 28 ranges from about 50 nm to about 500 μm.

The carbon nanotubes in the carbon nanotube wire 28 can be selected from a group consisting of single-walled, double-walled, and multi-walled carbon nanotubes. A diameter of each single-walled carbon nanotube approximately ranges from 0.5 nm to 50 nm. A diameter of each double-walled carbon nanotube approximately ranges from 1 nm to 50 nm. A diameter of each multi-walled carbon nanotube approximately ranges from 1.5 nm to 50 nm. A length of the carbon nanotubes in the carbon nanotube wire 28 can be in the range from about 1 nm to 5000 microns. In the present embodiment, the length of the carbon nanotubes is about 10 microns.

In operation, different voltage can be respectively applied to the cathode electrode 14 and the gate electrode 22 (e.g. the voltage of the cathode electrode 14 is zero or the cathode electrode 14 is electrically connected to the earth, and the voltage of the gate electrode 22 is positive and ranges from tens of volts to hundreds of volts). The electrons can be extracted from the cathode electrode 14 by an electric field generated by gate electrode 22 and the cathode electrode 14, and then the electrons travel through the spaces 24 in the gate electrode 22. The gate electrode 22 is a carbon nanotube layer. The carbon nanotube layer includes a plurality of spaces 24. The area of the spaces 24 is ranged from about 1 $\mu m^2$ to about 1 $cm^2$. The spaces distribute uniformly and can have small diameters. Therefore, a uniform electric field can be formed between the cathode electrode 14 and the gate electrode 22. Thus, the electron emission device 10 has a high efficiency and a high-resolution. Due to the carbon nanotube layer has a lower density compared with metal, the electron emission device 10 has a lower weight, and the electron emission device 10 can be easily used in a broader field.

Figure 7:
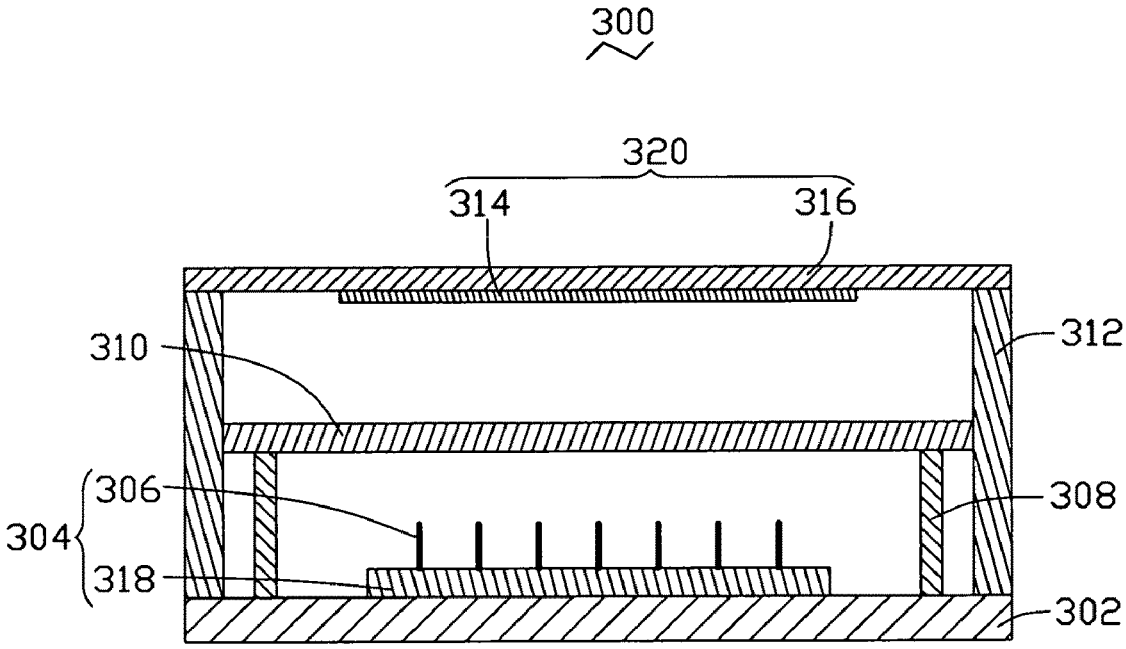
FIG. 7 is a schematic, cross-sectional view, showing a displaying device.

Referring to FIG. 7, a display device 300 employing the above-described electron emission device 10, according to another embodiment, is shown. The display device 300 includes a substrate 302, a cathode electrode 304 and a first insulating supporter 308 disposed on the substrate 302, a gate electrode 310 formed on a top surface of the first insulating supporter 308. The gate electrode 310 is electrically insulated from the cathode electrode 304 by the first insulating supporter 308. Further included are a second insulating supporters 312, disposed on the substrate 302, and an anode device 320 formed on a top surface of the second insulating supporters 312. The anode device 320 is electrically insulated from the cathode electrode 304 and the gate electrode 310 by the second insulating supporters 312.

The second insulating supporters 312 are used to support the anode device 320. The detailed shape of the second insulating supporters 312 is not limited, as long as the anode device is insulated from the cathode electrode 304 and the gate electrode 310. The second insulating supporters 312 are made of an insulation material, such as glass, silicon, ceramic, etc. In the present embodiment, the second insulating supporters 312 are made of glass. The second insulating supporters 312 are disposed on the substrate 302 and are longer than the first insulating supporter 308.

The anode device 320 includes an anode electrode 316 and a fluorescence layer 314. The anode device 320 is above the gate electrode 310. The fluorescence layer 314 is on a surface of the anode electrode 316 facing the gate electrode. The fluorescence layer 314 can be formed by a coating method.

The cathode electrode 304 can be field emission cathode electrode or hot emission cathode electrode. The detailed structure of the cathode electrode 304 is not limited. The cathode electrode includes at least one electron emitter 306.

The structure of electron emitter 306 is not limited, and may be one or more films or it can be arranged in an array. In the present embodiment, the cathode electrode 304 is field emission cathode electrode. The cathode electrode 304 includes a conductive layer 318 and a plurality of electron emitters 306 dispose thereon. The conductive layer 318 lays on the substrate 302, the electron emitters 306 are electrically connected to the conductive layer 318. The material of the conductive layer 318 is made of metal or any other suitable conductive materials. The electron emitters 306 can be selected from the group of silicon needles, metal needles or carbon nanotubes. In the present embodiment, the conductive layer 318 is an indium tin oxide film, the electron emitters 306 are carbon nanotubes.

The gate electrode 310 includes a carbon nanotube layer, whose structure is similar to the carbon nanotube layer used in electron emission device 10. The carbon nanotube layer includes a plurality of spaces, the spaces are gate holes. The spaces distribute equally in the carbon nanotube layer. The area of the spaces ranges from about 1 $\mu m^2$ to about 1 $cm^2$. The spaces have almost the same areas. The thickness of the carbon nanotube layer is in a range from about 2 μm to about 1 mm.

In operation, different voltage can be respectively applied to the anode electrode 316, the cathode electrode 304 and the gate electrode 310 (e.g., the voltage of the cathode electrode 304 is zero or the cathode electrode 304 is electrically connected to the earth, and the voltage of the gate electrode 310 is positive). The electrons can be extracted from the cathode electrode 304 by an electric field generated by gate electrode 310 and the cathode electrode 304. The electrons travel through the spaces in the gate electrode 310, then reach the fluorescence layer 314 on the surface of the anode electrode 316. The fluorescence layer 314 emits visible-lights. As the gate electrode 310 is a carbon nanotube layer, the CNT layer includes a plurality of spaces. The diameter of the spaces is ranged from 1 $\mu m^2$ to 1 $cm^2$. The spaces distribute equably and have small size, so the display device 300 has a high efficiency and a high-resolution. And the carbon nanotube layer has a lower density compared with metal, the display device 300 has a lower quality, the display device 300 can be used easily in a broad field.

It is to be understood that, the structures of electrode device and the anode device are not limited. The display device can be also used as a flat light source.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. An electron emission device comprising:

a cathode electrode comprising at least one electron emitter; and a gate electrode, the gate electrode being separated and insulated from the cathode electrode and the at least one electron emitter, wherein the gate electrode comprises a carbon nanotube layer having a plurality of substantially uniformly distributed spaces, the carbon nanotube layer comprises a plurality of carbon nanotube wire-like structures, each of the carbon nanotube wire-like structures comprises at least one twisted carbon nanotube wire comprising a plurality of carbon nanotubes joined end to end and oriented around an axial direction of the at least one twisted carbon nanotube wire.

2. The electron emission device as claimed in claim 1, wherein areas of the spaces range from about 1 $\mu m^2$ to about 1 $cm^2$.

3. The electron emission device as claimed in claim 1, wherein a thickness of the carbon nanotube layer ranges from about 2 μm to about 1 mm.

4. The electron emission device as claimed in claim 1, wherein the plurality of carbon nanotube wire-like structures is arranged along a first direction and a second direction.

5. The electron emission device as claimed in claim 4, wherein an angle exists between the first direction and the second direction, the angle is in the range from about 0 degrees to about 90 degrees.

6. The electron emission device as claimed in claim 5, wherein a diameter of each of the carbon nanotube wire-like structures ranges from about 1 μm to about 500 μm.

7. The electron emission device as claimed in claim 1, wherein each of the carbon nanotube wire-like structures comprises two or more twisted carbon nanotube wires, the carbon nanotube wires in the twisted carbon nanotube wire-like structures are parallel with each other or twisted with each other.

8. The electron emission device as claimed in claim 1, wherein the at least one twisted carbon nanotube wire comprises a plurality of successive carbon nanotube segments joined end to end by van der Waals attractive force therebetween.

9. The electron emission device as claimed in claim 8, wherein each of the carbon nanotube segments comprises a plurality of carbon nanotubes parallel to each other, and combined by van der Waals attractive force therebetween.

10. A display device comprising:

a cathode electrode comprising at least one electron emitter;

an anode electrode spaced from the cathode electrode and the at least one electron emitter; and a gate electrode disposed between the cathode device and the anode electrode;

wherein the cathode electrode, the anode electrode and the gate electrode are insulated from each other, the gate electrode comprises a carbon nanotube layer having a plurality of substantially uniformly distributed spaces, and the carbon nanotube layer comprises a plurality of carbon nanotube wire-like structures, each of the carbon nanotube wire-like structures comprises at least one twisted carbon nanotube wire comprising a plurality of carbon nanotubes joined end to end and oriented around an axial direction of the at least one twisted carbon nanotube wire.

11. The display device as claimed in claim 10, wherein areas of the spaces range from 1 $\mu m^2$ to 1 $cm^2$.

12. The display device as claimed in claim 10, wherein cathode electrode is a field emission cathode electrode or a hot emission cathode electrode.

13. The display device as claimed in claim 10, wherein a thickness of the carbon nanotube layer ranges from about 2 μm to about 1 mm.

14. The electron emission device as claimed in claim 1, wherein the cathode comprises a conductive layer and a plurality of electron emitters, the plurality of electron emitters are electrically connected to the conductive layer.

15. The electron emission device as claimed in claim 14, wherein the plurality of spaces of the carbon nanotube layer are located above the plurality of electron emitters and facing the plurality of electron emitters.

16. The electron emission device as claimed in claim 1, wherein the carbon nanotube layer is hung in the air above the at least one electron emitter.

17. The electron emission device as claimed in claim 10, wherein the carbon nanotube layer is hung in the air above the at least one electron emitter.

18. The electron emission device as claimed in claim 1, wherein each of the carbon nanotube wire-like structures further comprises at least one untwisted carbon nanotube wire comprising a plurality of carbon nanotubes oriented along an axial direction of the untwisted carbon nanotube wire.

19. The electron emission device as claimed in claim 1, wherein the plurality of carbon nanotube wire-like structures is knitted, weaved, crossed, or overlapped to form a net structure.

20. The electron emission device as claimed in claim 4, wherein the carbon nanotube wire-like structures arranged in the first direction comprises a plurality of carbon nanotubes joined end to end in the first direction, the carbon nanotube wire-like structures arranged in the second direction comprises a plurality of carbon nanotubes joined end to end in the second direction.

* * * * *